US009212043B2

(12) United States Patent
Sefjack

(10) Patent No.: US 9,212,043 B2
(45) Date of Patent: Dec. 15, 2015

(54) SYSTEM FOR DISPENSING FUEL FROM A FUEL PUMP AND RELATED DEVICE

(71) Applicant: Christopher M. Sefjack, Holiday, FL (US)

(72) Inventor: Christopher M. Sefjack, Holiday, FL (US)

( * ) Notice: Subject to any disclaimer, the term of this patent is extended or adjusted under 35 U.S.C. 154(b) by 226 days.

(21) Appl. No.: 13/838,257

(22) Filed: Mar. 15, 2013

(65) Prior Publication Data

US 2014/0261885 A1 Sep. 18, 2014

(51) Int. Cl.
*B67D 7/50* (2010.01)

(52) U.S. Cl.
CPC ..... *B67D 7/50* (2013.01)

(58) Field of Classification Search
CPC ..... B67D 7/04; B67D 7/06; B67D 7/42; B67D 7/50; B67D 7/52
USPC ..... 141/392; 251/90
See application file for complete search history.

(56) References Cited

U.S. PATENT DOCUMENTS

| | | | | |
|---|---|---|---|---|
| 4,210,181 | A * | 7/1980 | Clevenger | 141/392 |
| 4,334,560 | A * | 6/1982 | Lockwood | 141/392 |
| 4,337,917 | A * | 7/1982 | Tesack et al. | 251/90 |
| 8,905,092 | B2 * | 12/2014 | Sanders | 141/392 |

* cited by examiner

*Primary Examiner* — Timothy L Maust
(74) *Attorney, Agent, or Firm* — GrayRobinson, P.A.; Michael J. Colitz, III

(57) ABSTRACT

Disclosed is a system and associated device for dispensing fuel from a fuel pump. The system permits the hand-free operation of a fuel pump, thereby freeing the operator to perform other tasks simultaneously. The device is preferably designed to be carried on the key ring of the user and, when in use, is positioned in association with a fuel pump handle in an orientation that holds the operating lever of the handle in a position that permits fuel to flow. When the user has completed the dispensing of fuel, a rounded end of the device permits easy, carefree removal from the pump handle. For storage, the device can then be placed into a retracted conformation that enables the user to conveniently store and transport the device.

17 Claims, 2 Drawing Sheets

SYSTEM FOR DISPENSING FUEL FROM A FUEL PUMP AND RELATED DEVICE

TECHNICAL FIELD

This disclosure relates to a system and a device for dispensing fuel from a fuel pump.

BACKGROUND OF THE INVENTION

Currently when dispensing fuel from a fuel pump, such as when filling the fuel tank of an automobile at a gas station, the operator of the pump does not always have the option to lock the operating lever of the pump handle into a position that allows fuel to flow without holding the operating lever by hand. As is known in the art, some fuel pump handles contain a locking lever associated the operating lever that, when properly positioned, allows the operator to lock the operating lever into a position that permits the hands-free fueling of the automobile. However, not all fuel pump handles are equipped with such a locking lever, forcing the operator to manually compress the operating lever of the fuel pump handle until the desired amount of fuel is dispensed. Thus, there exists a need in the field for a system that, in the absence of a locking lever, enables a fuel-pump operator to lock the operating lever into a position that permits the hands-free dispensing of fuel.

SUMMARY OF THE INVENTION

This disclosure provides a system and device for dispensing fuel from a fuel pump.

An embodiment of the system may comprise a gas pump handle with an operating lever and a lever locking device, wherein the lever locking device is capable of retaining the gas pump operating lever in a position that allows for the hands-free dispensing of fuel from the fuel pump.

An embodiment of the device may include a lever locking device comprising a first housing component, a second housing component, and a central shaft, whereby the first housing component and the second housing component are associated by way of the central shaft.

Another embodiment of the invention may further comprise a key chain ring detachably interconnected to the lever locking device.

The disclosed system and device have several important advantages. For example, providing for the hands-free operation of a fuel pump in the absence of a native mechanism permitting the same.

A further possible advantage is the convenience and portability of the disclosed device, which may be conveniently stored or used as a primary key ring.

Various embodiments of the invention may have none, some, or all of these advantages. Other technical advantages of the present invention will be readily apparent to one skilled in the art.

BRIEF DESCRIPTION OF THE DRAWINGS

For a more complete understanding of the present disclosure and its advantages, reference is now made to the following descriptions, taken in conjunction with the accompanying drawings, in which.

DETAILED DESCRIPTION OF THE DRAWINGS

The present invention will now be described more fully hereinafter with reference to the accompanying drawings, in which embodiments of the invention are shown by way of illustration and example. This invention may, however, be embodied in many forms and should not be construed as limited to the embodiments set forth herein. Rather, these embodiments are provided so that this disclosure will be thorough and complete, and will fully convey the scope of the invention to those skilled in the art. Like numerals refer to like elements throughout the several views of the drawings.

Figure 1:
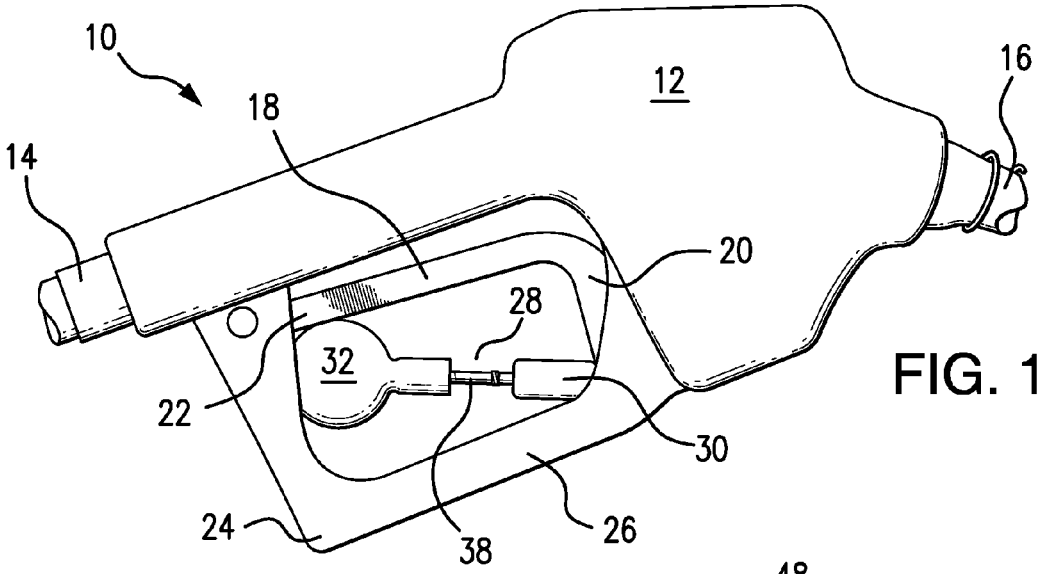
FIG. 1 is a diagrammatical illustration of a lever locking device in association with a fuel pump handle.

By way of example and with reference initially to FIG. 1, one embodiment of the invention comprises a system for dispensing fuel from a pump. The system includes a fuel pump handle 10, having a main housing 12 with a hose 14 and a nozzle 16. An operating lever 18 is associated with the handle 10. Operating lever 18 has a proximal end 20 adjacent the pivot point and an opposite distal 22 end. Lever 18 also includes first and second orientations. Fuel is dispensed from nozzle 16 in the first orientation, and fuel is prevented from being dispensed from nozzle 16 when lever 18 is the second orientation. A lever guard 24 surrounds lever 18. Lever guard 18 has a base portion 26 opposite the operating lever 18. The system likewise includes a lever locking device 28 that is selectively positioned between lever 18 and base portion 26. Lever locking device 28 is described in greater detail in connection with FIGS. 2-4.

Lever locking device 28 preferably includes a first rectangular housing component 30 and a second rounded housing component 32. The use of other shapes for housings 28 and 30 is within the scope of the present invention. Housing 30, however, is preferably large enough to include indicia or logos. First housing component 30 includes a first bore with a threaded extent 34. Second housing component 32 likewise includes a second bore with a threaded extent 36. A central shaft 38 is included with first 40 and second 42 threaded extents. The first threaded extent 40 of the central shaft 38 is threadably secured to the threaded extent of the first bore 34. This threaded connection may be fixed to prevent removal of shaft 38 from housing 30. A spring 44 with a bias is positioned within the second bore. Spring 44 has compressed and uncompressed orientations. The central shaft 38 is slidably received within the second bore and against the bias of the spring 44. Central shaft 38 may be fixed to a distal end of spring 44. Likewise, spring 44 may be fixedly secured within housing 32 to prevent its removal.

Thus, the second housing component 32 has an extended position wherein the spring 44 is uncompressed and there is a greater distance between housings 30 and 32. This may be the preferred orientation for inserting device 28 between lever 18 and base portion 26. The distance between lever 18 and base portion 26 may vary between pumps. As such, the extended position allows central shaft 38 to freely reciprocate within housing 32. The bias of spring 44 against central shaft 38 allows device 28 to be securely positioned between lever 18 and base portion 26. In the retracted position, spring 44 is fully compressed and housing component 32 is locked by engaging the second threaded extent 42 of the shaft 38 with the threaded extent 36 of the second bore. This is the preferred orientation for transport.

Figure 5:
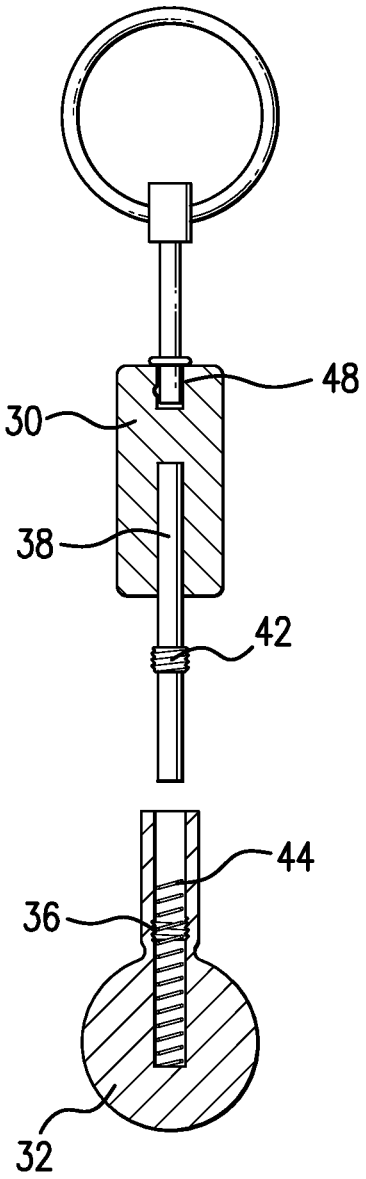
FIG. 5 is a diagrammatical illustration of an alternative embodiment of the lever locking device.

In an alternative embodiment shown in FIG. 5, the threaded connection between shaft 38 and housing 30 is eliminated. Instead, shaft 38 is fixed within housing 30 via a permanent connection. Additionally, the retracted position is achieved by engaging threads 42 with mating threads 36 within housing 32. Again, the end of shaft 38 is fixedly connected to spring 44 and spring 44, in turn, is fixedly connected to the interior of housing 42. These connections can be achieved by fasteners or adhesives and are designed at preventing spring 44 and shaft 38 from being completely removed from housing 32. In still yet another embodiment, threads 42 can be eliminated from shaft 38 in favor of a threaded connection between housings 30 and 32. Namely, male threads are included at the outer extent of housing 32 and mating female threads are included on the interior of a bore formed within housing 30. In this embodiment, the retracted position would be attained by simply screwing housing 32 into housing 30.

With reference again to FIGS. 1-3, the second housing 32 in the extended position, the lever locking device 28 can be used to retain the operating lever 18 in the first orientation by positioning the rounded housing component 32 against the distal end 22 of the operating lever 18 and the first rectangular housing component 30 against the base portion 26 of the lever guard 24.

Figure 2:
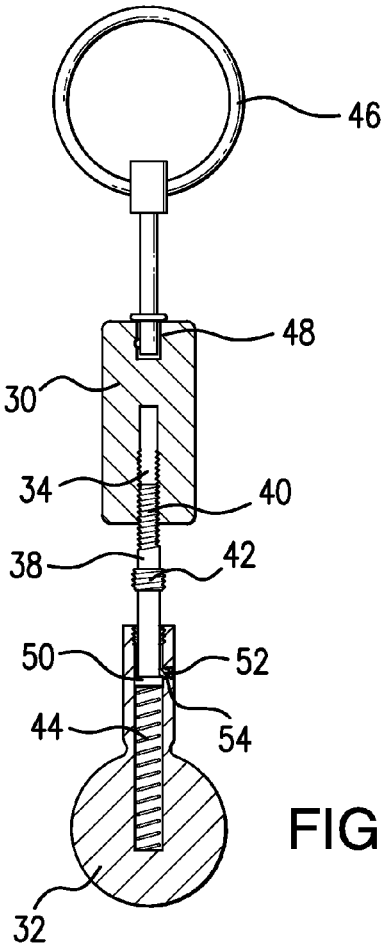
FIG. 2 is a diagrammatical illustration of a lever locking device in an extended position with an associated detachable key ring.
Figure 3:
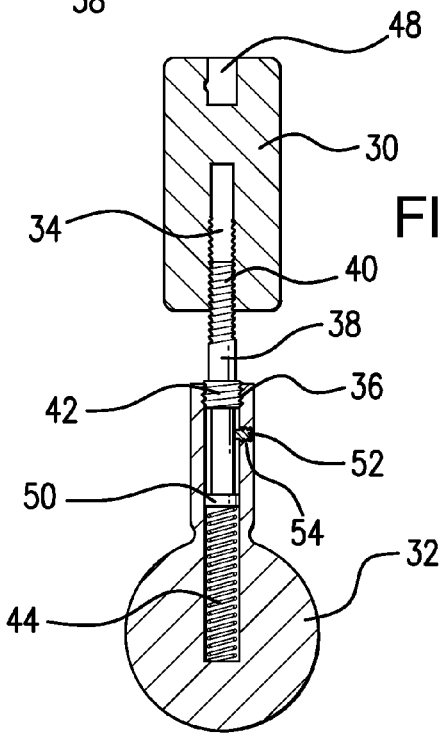
FIG. 3 is a diagrammatical illustration of a lever locking device in a retracted position, with the detachable key ring having been removed.
Figure 4:
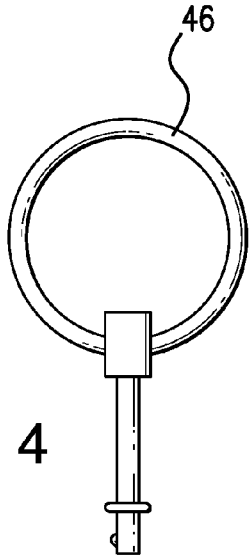
FIG. 4 is a diagrammatical illustration of a detachable key ring.

With continued reference to FIGS. 1-3, and now to FIG. 4, a key chain ring 46 detachably interconnected to the first rectangular housing component 30. By way of example, and with continued reference to FIGS. 2-4, one embodiment of the invention may comprise a first rectangular housing component 30 further comprising an auxiliary bore 48 capable to detachably receiving a detachable key chain ring 46.

With continued reference to FIGS. 2-3, another embodiment of the invention may comprise a grub 50 at the end of the shaft 38, whereby the insertion of a grub screw 52 through a grub bore 54 having a threaded extent in the second housing 30 prevents the shaft 38 from being fully withdrawn from the second bore 36.

In yet another embodiment of the invention, the spring 44 may be attached on one end to the shaft 38 and attached on the other end to the interior of the second housing 32, thereby preventing the complete withdraw of the shaft 38 and the spring 44 from the second bore 36.

In one embodiment of the invention, the first housing 30 and the second housing 32 is made from stainless steel or other material having similar physical properties or characteristics.

In another embodiment of the invention, the first housing 30 and the second housing 32 is made from plastic or other material having similar physical properties or characteristics.

In another embodiment of the invention, the first threaded extent 40 of the shaft 38 is fixed and not capable of removal following being threadably connected to the threaded extent of the first bore 34 of the first housing component 30.

In yet another embodiment of the invention, the first threaded extent 40 of the shaft 38 and the threaded extent of the first bore 34 are oriented opposite to the second threaded extent 42 of the shaft 38 and the threaded extent of the second bore 36 whereby the unscrewing of the one tightens the other and vice versa, thereby preventing the loosening of the connection between the first threaded extent 40 of the shaft 38 and the threaded extent of the first bore 34 when unlocking the retracted position by unscrewing the connection between the second threaded extent 42 of the shaft 38 and the threaded extent of the second bore 36.

In yet another embodiment of the invention, the first housing component 30 and the second housing component 32 are capable of supporting a graphic image, logo, or the like.

Although this disclosure has been described in terms of certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure.

What is claimed is:

1. A system for dispensing fuel from a pump, the system comprising:

a fuel pump handle, the handle including a main housing with a hose and a nozzle, an operating lever associated with the handle, the operating lever having proximal and distal ends and first and second orientations, fuel being dispensed from the nozzle in the first orientation and fuel not being dispensed from the nozzle in the second orientation, a lever guard surrounding the lever, the lever guard having a base portion opposite the operating lever;

a lever locking device having a first rectangular housing component and a second rounded housing component, the first housing component including a first bore with a threaded extent, the second housing component including a second bore with a threaded extent, a central shaft having first and second threaded extents, the first threaded extent of the central shaft being threadably secured to the threaded extent of the first bore, a spring with a bias positioned within the second bore, the spring having compressed and uncompressed orientations, the central shaft being slidably received within the second bore and against the bias of the spring, the second housing component having an extended position wherein the spring is uncompressed and a retracted position wherein the spring is compressed, the second housing component being selectively locked in the retracted position by lockingly engaging the second threaded extent of the shaft with the threaded extent of the second bore;

whereby with the second housing in the extended position, the lever locking device can be used to retain the operating lever in the first orientation by positioning the rounded housing component against the distal end of the operating lever and the first rectangular housing component against the base portion of the lever guard; and a key chain ring detachably interconnected to the first rectangular housing component.

2. A system for dispensing fuel from a pump, the system comprising:

a fuel pump handle, the handle including a main housing with a hose and a nozzle, an operating lever associated with the handle, the operating lever having proximal and distal ends and first and second orientations, fuel being dispensed from the nozzle in the first orientation and fuel not being dispensed from the nozzle in the second orientation, a lever guard surrounding the lever, the lever guard having a base portion opposite the operating lever;

a lever locking device having a first housing component, a second housing component, and a central shaft, and whereby the first housing component is associated with the second housing component by way of the central shaft;

the first housing component includes a first bore with a threaded extent, the second housing component includes a second bore with a threaded extent, and the central shaft has first and second threaded extents, the first threaded extent of the central shaft being threadably secured to the threaded extent of the first bore;

a spring with a bias positioned within the second bore, the spring having compressed and uncompressed orientations;

whereby the lever locking device can be used to retain the operating lever in the first orientation.

3. The system for dispensing fuel from a pump according to claim 2, wherein the central shaft is slidably received within the second bore and against the bias of the spring.

4. The system for dispensing fuel from a pump according to claim 3, wherein the second housing component has an extended position wherein the spring is uncompressed and a retracted position wherein the spring is compressed.

5. The system for dispensing fuel from a pump according to claim 4, wherein the second housing component is selectively locked in the retracted position by lockingly engaging the second threaded extent of the shaft with the threaded extent of the second bore.

6. The system for dispensing fuel from a pump according to claim 4, whereby with the second housing in the extended position, the lever locking device can be used to retain the operating lever in the first orientation by positioning the second housing component against the distal end of the operating lever and the first housing component against the base portion of the lever guard.

7. The system for dispensing fuel from a pump according to claim 2, wherein the first housing component is rectangular and the second housing component is rounded.

8. The system for dispensing fuel from a pump according to claim 2, further comprising a key chain ring detachably interconnected to the lever locking device.

9. The system for dispensing fuel from a pump according to claim 2, further comprising a key chain ring detachably interconnected to the first housing component.

10. A fuel pump operating lever locking device, the lever locking device comprising:

a first housing component;

a second housing component; and a central shaft, whereby the first housing component is associated with the second housing component by way of the central shaft;

wherein the first housing component includes a first bore with a threaded extent, the second housing component includes a second bore with a threaded extent, and the central shaft has first and second threaded extents, the first threaded extent of the central shaft being threadably secured to the threaded extent of the first bore;

a spring with a bias positioned within the second bore, the spring having compressed and uncompressed orientations.

11. The lever locking device according to claim 10, wherein the central shaft is slidably received within the second bore and against the bias of the spring.

12. The lever locking device according to claim 11, wherein the second housing component has an extended position wherein the spring is uncompressed and a retracted position wherein the spring is compressed.

13. The lever locking device according to claim 12, wherein the second housing component is selectively locked in the retracted position by lockingly engaging the second threaded extent of the shaft with the threaded extent of the second bore.

14. The lever locking device according to claim 12, whereby with the second housing in the extended position, the lever locking device can be used to retain the operating lever in an orientation permitting fuel to flow from the fuel pump.

15. The lever locking device according to claim 10, wherein the first housing component is rectangular and the second housing component is rounded.

16. The lever locking device according to claim 10, further comprising a key chain ring detachably interconnected to the lever locking device.

17. The lever locking device according to claim 10, further comprising a key chain ring detachably interconnected to the first housing component.

* * * * *